US006030191A

United States Patent [19]

Wood et al.

[11] Patent Number: 6,030,191

[45] Date of Patent: Feb. 29, 2000

[54] LOW NOISE ROTARY VANE SUCTION PUMP HAVING A BLEED PORT

[75] Inventors: Gregory P. Wood, Kentwood; Michael D. Walters, Hudsonville, both of Mich.

[73] Assignee: Delaware Capital Formation, Inc., Wilmington, Del.

[21] Appl. No.: 08/915,445

[22] Filed: Aug. 20, 1997

[51] Int. Cl.[7] ..... F04C 2/344

[52] U.S. Cl. ..... 418/1; 418/15; 418/178; 418/180; 418/181

[58] Field of Search ..... 418/1, 15, 78, 418/178, 180, 181

[56] References Cited

U.S. PATENT DOCUMENTS

| | | | |
|---|---|---|---|
| 2,619,911 | 12/1952 | Svenson | 418/180 |
| 3,182,596 | 5/1965 | Prijatel | 418/180 |
| 4,925,372 | 5/1990 | Hansen | 418/15 |
| 5,413,470 | 5/1995 | Eisenmann | 418/171 |
| 5,431,552 | 7/1995 | Schuller et al. | 418/15 |

FOREIGN PATENT DOCUMENTS

| | | | |
|---|---|---|---|
| 0 619 430A1 | 10/1994 | European Pat. Off. . | |
| 1019964 | 11/1957 | Germany | 418/181 |
| PCT/US98/00606 | 5/1999 | WIPO . | |

OTHER PUBLICATIONS

Blueprint, Blackmer ML4 Pump Liner, Dec., 1987 (2 pages).

*Primary Examiner*—John J. Vrablik

*Attorney, Agent, or Firm*—Flynn, Thiel, Boutell & Tanis, P.C.

[57] ABSTRACT

A suction pump (22) suitable for use in a fuel dispensing system (20) or other fluid delivery system for volatile liquids. The suction pump includes a pump casing that defines a pump chamber (52) with inlet and outlet ports. A rotor (54) with vanes (58) is seated in the pump chamber. The vanes define fluid cavities (96*a*, 96*b*, 96*c*, . . . 96*f*) that rotate between the inlet and outlet ports. During each turn of the rotor, each fluid cavity passes through a section of the pump chamber in which it is isolated from both the inlet port and outlet port. A bleed duct (102) extends from the outlet port. A bleed port (104) extends from the bleed duct to the section of the pump chamber that defines the isolated position of the fluid cavities. During operation of the pump, pressurized fluid discharged from the outlet port flows through the bleed duct and bleed port into the isolated fluid cavity. This pressurized fluid compresses vapor bubbles in the fluid cavity to prevent their rapid decompression when the cavity is later subjected to additional decompression. This initial decompression of the vapor bubbles reduces the noise generated when the fluid cavity is subjected to rapid compression when it is positioned adjacent the outlet port.

21 Claims, 5 Drawing Sheets

FIG. 4
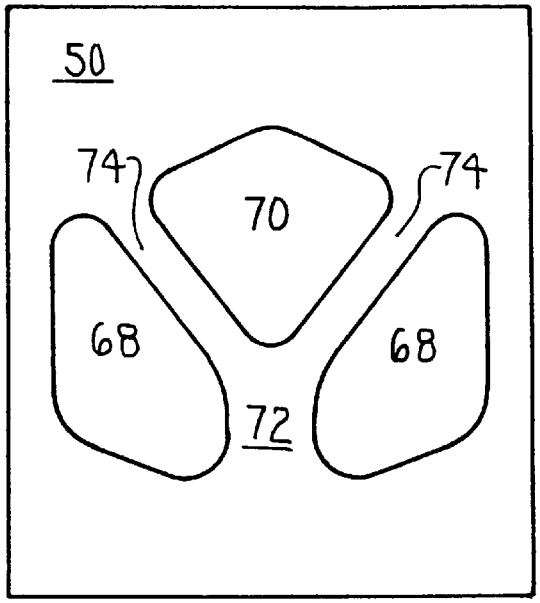
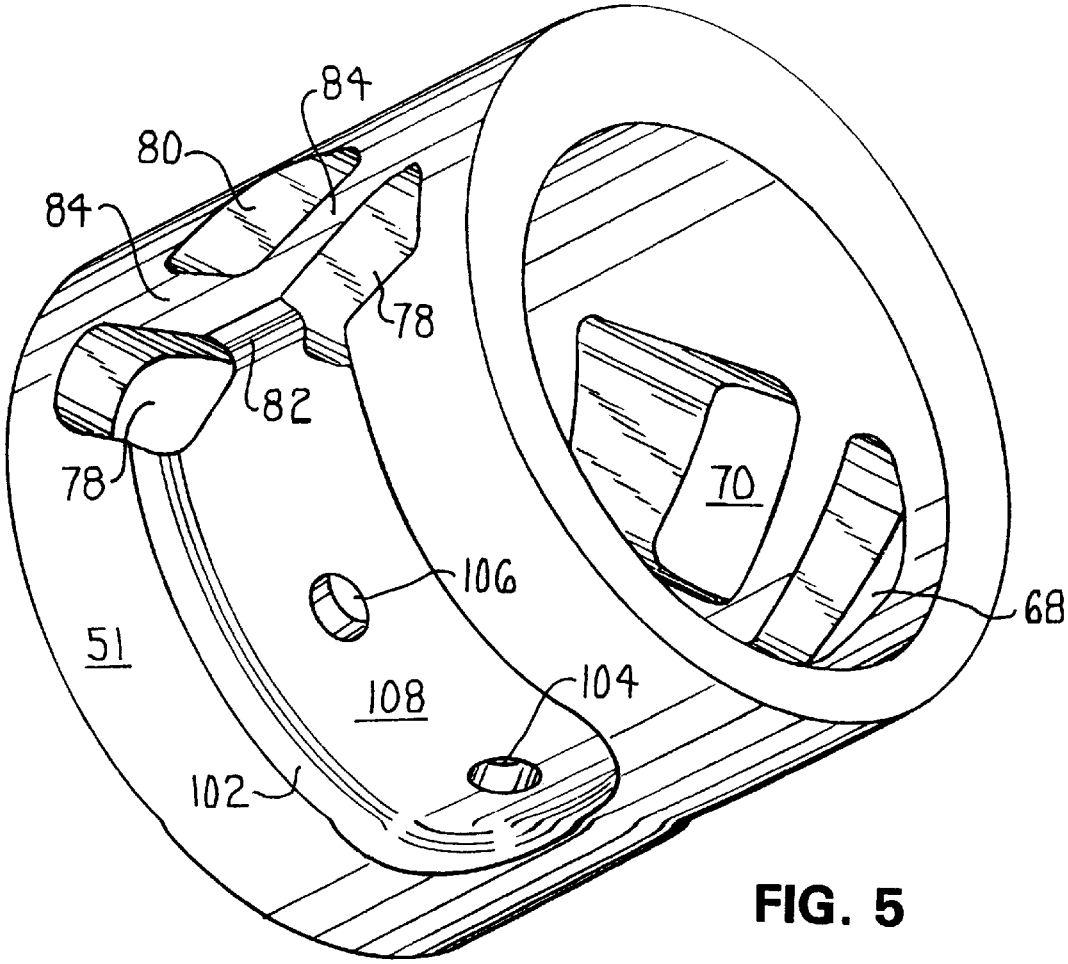
FIG. 5

LOW NOISE ROTARY VANE SUCTION PUMP HAVING A BLEED PORT

FIELD OF THE INVENTION

This invention relates generally to suction pumps and, more particularly, to a low noise suction pump useful for pumping volatile liquids.

BACKGROUND OF THE INVENTION

Suction pumps are used in many processes to transfer liquids from first locations to second locations. A typical suction pump includes a pump casing that defines a pump chamber. A rotor that is rotated by a motor is seated in the pump chamber. Seated in the rotor are a number of vanes. As the rotor turns, the centrifugal force developed urges the vanes outwardly towards the wall of the pump chamber that defines the pump chamber. Owing to the geometry of the pump chamber and the position of the rotor in the pump chamber, a vacuum develops in the interstitial spaces between the vanes, referred to as fluid cavities. As each fluid cavity is presented to the inlet of the pump chamber, this vacuum presents a suction head to the liquid being pumped. Liquid is thus drawn into the fluid cavity and rotates with the fluid cavity. As the rotor turns, the size of the fluid cavity decreases as it approaches the outlet of the pump chamber. This change in size of the fluid cavity forces the liquid out of the pump chamber and through the outlet line connected to the pump.

One particular fluid delivery system in which a suction pump is often employed is a fuel dispensing system. A typical fuel dispensing system is designed to draw fuel from an underground storage tank in which the fuel, (gasoline, diesel fuel, kerosene, alcohol, liquid-state propane, liquid-state butane, other liquified gases and other liquid-state fuels that are highly volatile) is stored. The dispensing system includes a pump that forces the fuel to and through an above ground hose-and-nozzle subassembly. Flow through the pump is often regulated by a nozzle-controlled on/off valve. There is also a flow meter that monitors the volume of fuel dispensed to provide the data required to ensure that the customer is accurately charged for the quantity of fuel delivered. When a suction pump is employed in a fuel dispensing system, the pump draws fuel from the storage tank and then forces it through the downline dispensing system components. Should any leaks develop in the supply line from the storage tank, the suction drawn by the pump, instead of allowing the fuel to flow out, will draw air into the line. Thus, employing a suction pump in a fuel dispensing system serves to minimize unwanted fuel leakage and the attendant environmental damage such leakage can foster.

While suction pumps serve as useful devices for generating a fluid flow in many systems, such as fuel dispensing systems, there are some disadvantages associated with their use. One particular disadvantage associated with many fluid pumps is that when they are running, they generate a significant amount of noise. This noise is generated because, as the liquid enters a fluid cavity, it has an opportunity to expand volumetrically. Some liquids partially vaporize. Then, when the fluid cavity decreases in size, the liquid compresses. This compression causes the bubbles of vaporized fluid to collapse. This collapsing, "popping," of the vapor bubbles can generate significant amounts of noise. This vaporization and subsequent condensation of fluid is especially prone to occur if the fluid is volatile when in the liquid-state, as are many fuels. In a fuel dispensing system, the suction pump is typically located in the above-ground housing that contains most of the other components of the dispensing system. Thus, the noise generated by the pump during its operation can readily be heard by an individual using the dispensing system. If the fuel has a relatively high vapor pressure, the noise can be relatively loud. If the noise is loud enough, the person using the system may even become so concerned that he/she will stop pumping fuel due to a belief that the dispensing system is malfunctioning. Once a person takes this step, it appreciably lengthens the overall time it takes to perform the fuel dispensing process.

There have been some attempts to minimize the of noise generated by suction pumps by slowing the r of rotation of the pump rotor. A disadvantage of this technique is that, for a given size pump, it reduces the rate at which the pump pumps liquid. Consequently, in some liquid dispensing systems, it is necessary to increase pump size in order to compensate for this drop in liquid-pumping efficiency. Other attempts have been made to reduce the amount of noise that is generated by simply providing acoustic insulation around the pump. This insulation serves to increase the overall size of the pump. These larger pumps required to hold the generated noise to a minimum can be(difficult to install in locations where space is at a premium, such as the inside of a fuel dispenser housing.

SUMMARY OF THE INVENTION

This invention relates to an improved suction pump that does not generate significant amounts of noise during its operation. While the suction pump of this invention can be employed in many fluid delivery systems, it is especially well suited for use in a fuel dispensing system that delivers volatile fuels.

BRIEF DESCRIPTION OF THE DRAWINGS

The invention is pointed out with particularity in the appended claims. The above and further advantages of the invention may be better understood by reference to the following description taken in conjunction with the accompanying drawings, in which:

FIG. 4 is a side view illustrating the inlet ports formed in the liner;

FIG. 5 is a perspective view of the liner of the pump of this invention;

DETAILED DESCRIPTION

Figure 1:
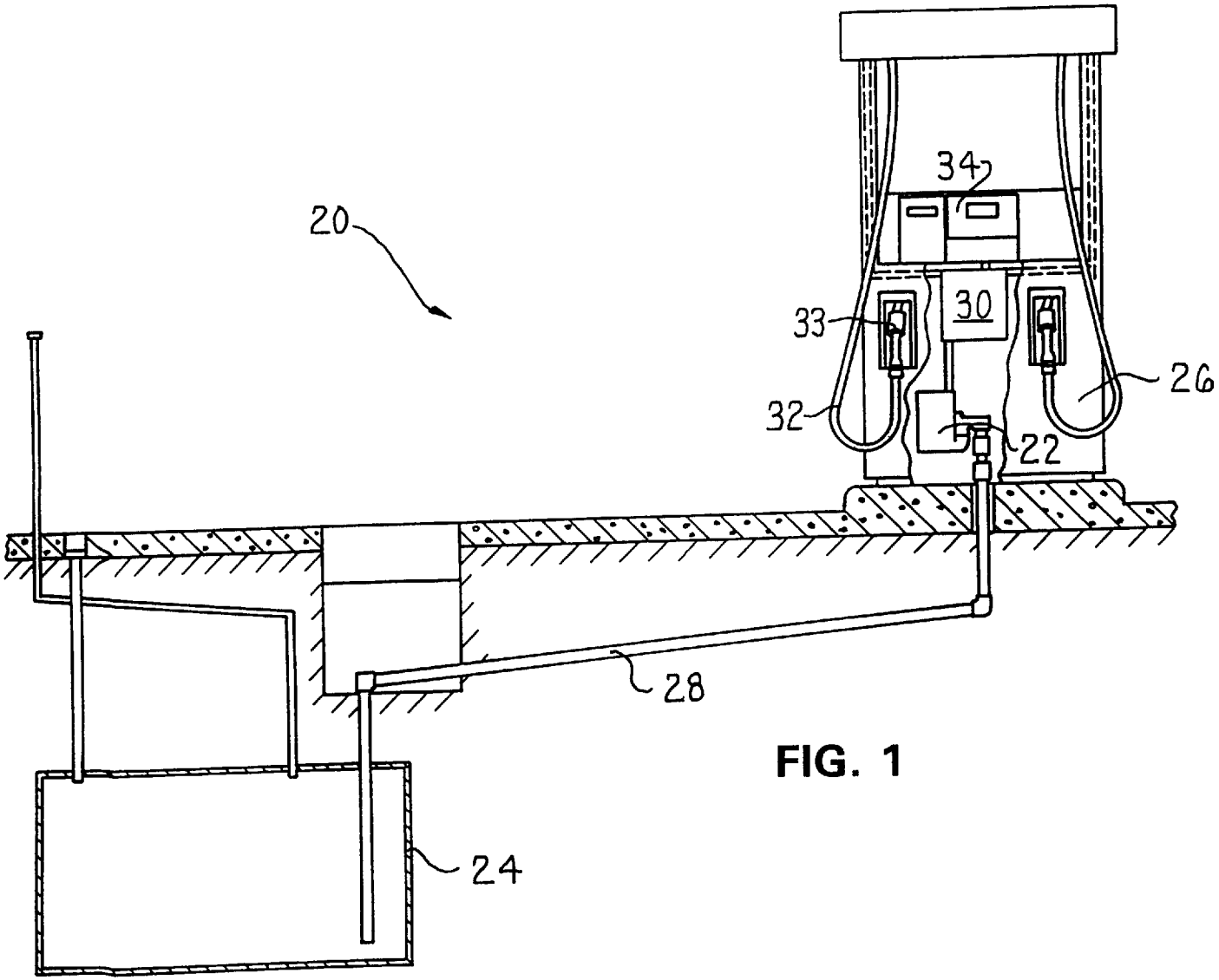
FIG. 1 is a diagrammatic view of a dispensing system employing the suction pump of this invention.

FIG. 1 illustrates a fuel dispensing system 20 that includes a suction pump 22 of this invention. The liquid-state fuel is contained in an underground storage tank 24. The dispensing system 20 is contained within an above ground dispensing unit 26 in which the pump 22 is housed. Fuel is drawn from the storage tank 24 into pump 22 through a supply line 28. The fuel is then discharged from the pump into a flow meter 30 and then through a flexible hose 32 for delivery into a vehicle. The flow meter 30 provides a volumetric measure of the quantity of the fuel that is delivered to the vehicle. Data signals representative of this volumetric measure are supplied by the flow meter 30 to a processing unit 34. The processing unit 34 both displays an indication of the quantity of the fuel delivered and an indication of the charge to the customer. Fuel flow through the system 20 is controlled by a nozzle 33 attached to the free end of the hose 32.

Figure 2:
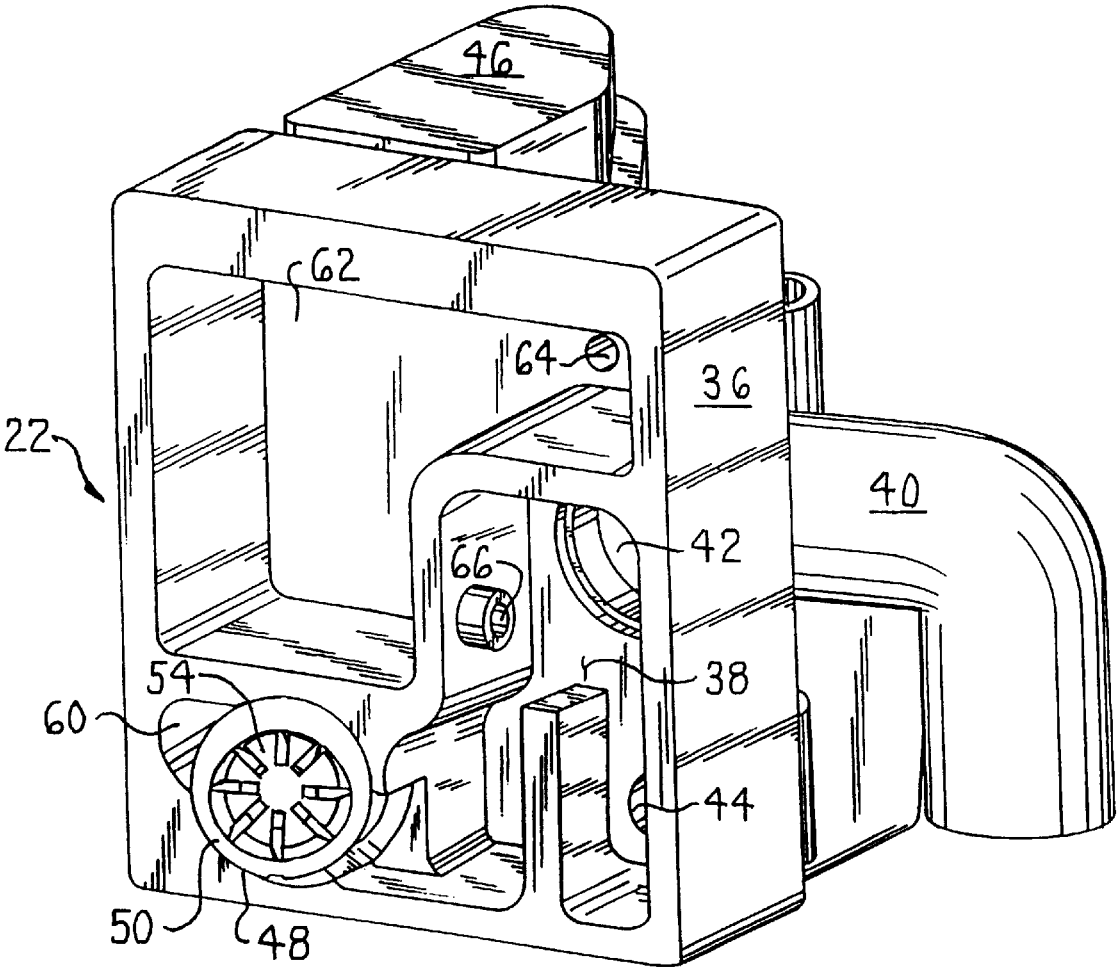
FIG. 2 is an isometric view of the suction pump.

The suction pump 22 of this invention is now described by initial reference to FIG. 2. The pump 22 includes a casing body 36 that houses the other components of the pump. Normally, casing body 36 is sealed by a face plate that is herein not illustrated in order to allow the other components of the pump 22 to be depicted. Casing body 36 is shaped to define an inlet chamber 38 to which an inlet line 40, which is an extension of supply line 28, is connected. Casing body 36 is formed with an opening 42 to allow fuel flow from inlet line 40 into inlet chamber 38. While not illustrated, in many preferred versions of the invention, a strainer is fitted over opening 42 to prevent contaminates from entering inlet chamber 38 with the fuel. Inlet chamber 38 is provided to reduce the velocity of the fuel flowing into the pump 22. This reduction in velocity is desirable to keep the net positive suction head required of pump 22 as low as possible.

The depicted casing body 36 is also provided with a bypass opening 44 into the inlet chamber 38. Bypass opening 44 is the port through which fuel from an air separator 46 is returned back into the pump. While not part of this invention, it should be understood that air separator 46 is employed with pump 22 to remove air entrained into the fuel stream discharged from the pump from the fuel stream before the fuel is subjected to metering by the flow meter 30. A bypass valve, (not illustrated) is seated over bypass opening 44 in the inlet chamber 38 to ensure that flow through opening 44 is only one-way, into the chamber, and only occurs when the pressure head of the flow through the air separator 46 reaches a select level.

Figure 3:
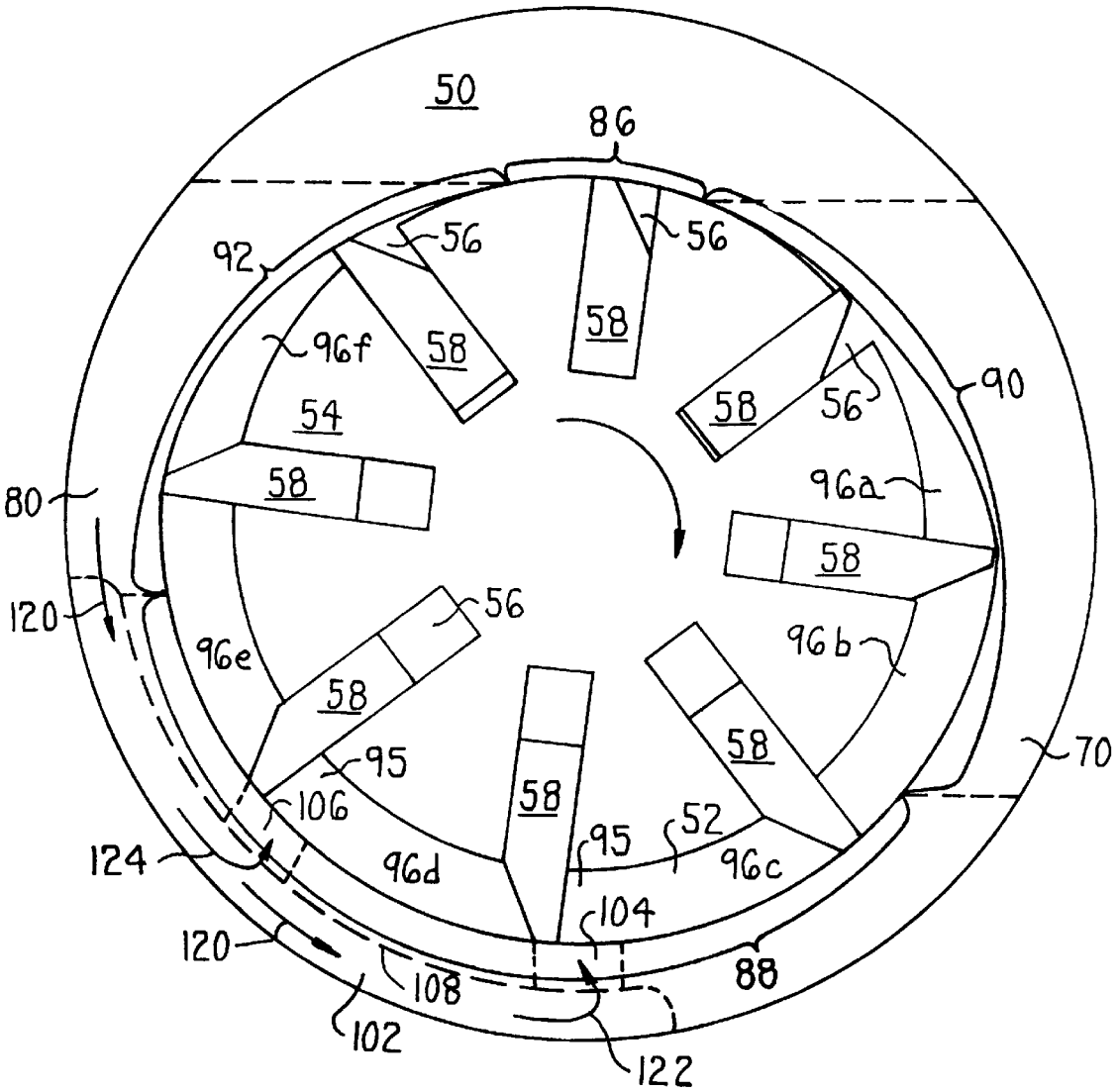
FIG. 3 is a plan view of the liner, pump rotor and vanes forming the suction pump.

Casing body 36 is further formed to define a circular bore 48 in which the actual moving components of the pump 22 are housed. Bore 48 is in fluid communication with inlet chamber 38 and is located adjacent the gravity-centered base of casing body 36 to create flooded suction at all times. A liner 50 is seated inside bore 48. More specifically, liner 50, now briefly described with respect to FIGS. 3 and 5, is shaped to have an outer surface 51 that is dimensioned to be slip fitted against the adjacent surfaces of casing body 36 that define bore 48. The inner wall of liner 50 defines a pump chamber 52. A rotor 54 is seated in the pump chamber 52. Rotor 54 is formed with slots 56 in which vanes 58 are seated. The rotor is provided with a shaft, (not illustrated,) that extends out through an opening in the face plate seated over casing body 36. The shaft is coupled to a motor, (not illustrated,) that provides the motive power for actuating the rotor.

Returning to FIG. 2, it will further be noted that casing body 36 is formed with a discharge bore 60 that is in fluid communication with bore 48. The fuel discharged by the pump 22 is forced through discharge bore 60 into the air separator 46. In the illustrated version of the invention, casing body 36 is formed with an air elimination chamber 62 that is located above inlet chamber 38 and bore 48. Air elimination chamber 62 is part of the air separator 46. Vapor-laden air that is removed by other components of the air separator is vented to the air elimination chamber 62 through an opening 64 in the casing body 36. The vapor in this air stream condenses and falls to the bottom of the air elimination chamber 62. The condensed, liquid-state fuel is then returned to inlet chamber 38 through an opening 66 in the wall of the casing body 36 that separates the air elimination chamber 62 from the inlet chamber 38. A float valve, (not illustrated,) normally seals opening 66. When there is a large quantity of fuel in the air elimination chamber 62, the float valve opens to allow the fuel to flow into the inlet chamber 38.

The components forming the actual pumping unit of suction pump 22 are now described in greater detail by further reference to FIGS. 3, 4 and 5. Liner 50 is shaped to define two openings 68 and an opening 70 that collectively form the inlet port between inlet chamber 38 and pump chamber 52. Relative to the opposed flat ends of liner 50, openings 68 form the top and bottom ports into pump chamber 52. Openings 68 are separated by a web 72 integral with liner 50 are symmetrically shaped relative to web 72. Opening 70 is located between openings 68 and is separated from openings 68 by two webs 74. Webs 74, will be observed, extend from the free end of web 72.

The outlet port between pump chamber 52 and discharge bore 60 is formed by two openings 78 and an opening 80 in liner 50. Openings 78 are separated by a web 82 and are symmetrically shaped relative to the web 82. Opening 80 is located between openings 78. Each opening 78 is separated from opening 80 by a separate web 84. Webs 84 each extend from the free end of web 82.

Liner 50 is shaped so that pump chamber 52 has an eccentric profile. More particularly, the inner wall of liner 50 is shaped to have a first and second true radius sections 86 and 88, respectively, that extend between the portions of the liner that define the inlet port and the outlet port. By true radius, it is understood that sections 86 and 88 of the inner wall have a constant radius circular profile. Liner 50 is further shaped to have a first eccentric section 90 located around the portion of the inner wall that is subtended by inlet openings 68 and 70. There is a second eccentric section 92 located around the portion of the inner wall that is subtended by outlet openings 78 and 80. Eccentric sections 90 and 92 of the inner wall of the liner 50 are shaped so that while the profile of the liner is curved, the radius of curvature changes along the arcs of the sections. Consequently, it will be noted that the radius curvature of the second true radius section 88 is greater than the radius of curvature of the first true radius section 86.

Rotor 54 is seated in pump chamber 52 so as to axially aligned with the axis of curvature of the first true radius section 86. The rotor 54 is shaped so as to have an outer diameter that is only slightly less than the diameter inscribed by the first true radius section 86 of liner 50. The outer surface of the rotor 54 and the inner wall of liner 50 that defines the second true radius section 88 thus define a fluid transport section 95 within pump chamber 52 through which the fuel flows from openings 68 and 70 to openings 78 and 80. In the depicted version of the invention, the fluid transport section 95 is generally subtended by and are defined by the second true radius section. This relationship may not be present in each version of this invention. The rotor 54 is provided with a number of vanes 58. As the rotor 54 turns (clockwise in FIG. 3), the vanes 58 are urged outwardly against the inside wall of the liner 50. The spaces in the pump chamber 52 between the individual vanes 58 are referred to as fluid cavities 96*a*, 96*b*, 96*c*, . . . 96*f*.

In the pump 22 of this invention, rotor 54 is provided with a sufficient number of vanes 58 so that there is at least one fluid cavity wholly within the fluid transport section 95. In the illustrated version of the invention, it will be noted that fluid cavities 96*a* and 96*b* subtend the first eccentric section 90 of liner 50, the section through which fuel is drawn into pump chamber 52 through openings 68 and 70. Fluid cavities 96*c* and 96*d*, subtend the fluid transport section 95. In other words, as depicted by fluid cavities 96*c* and 96*d*, during the rotation of rotor 54, each fluid cavity is momentarily isolated from both the inlet and outlet ports to the pump chamber 52. Fluid cavities 96*e* and 96*f* subtend the second eccentric section 92 of the liner, the section through which fluid is discharged through openings 80 and 82.

Liner 50 is further formed to define a bleed duct 102 that extends from openings 78 to the portion of the liner that defines the second true radius section 88 of the inner wall of the liner. Two bleed ports 104 and 106 extend from bleed duct 102 through the inner wall of the liner into the portions of the pump chamber 52 through which the fuel is moved. More particularly, bleed port 104 is positioned to open into fluid cavity 96*c*; bleed port 106 is positioned to open into fluid cavity 96*d*.

Bleed duct 102 is defined by an inwardly stepped surface 108 formed in the liner outer surface 51. Stepped surface 108 extends from openings 78 to the outer surface of the liner 50 adjacent the second true radius section 88. The width of bleed duct 102 is substantially wider than the diameter of bleed ports 104 and 106. It will further be understood that in the described version of the invention, bleed port 104 is located away from the end of the bleed port 102 distal to openings 78.

The diameter of each bleed port 104 and 106 is a function of the pressure of the liquid flowing through the pump 22 and the extent to which the bleed port is used as conduit for bleed flow to reduce cavitation, the extent to which a fluid cavity is filled with vapor-state fluid. More particularly, the size of each of the bleed port 104 and 106 is a function of the volume of the fluid cavity with which the port is in fluid communication, the volume of liquid, bleed flow, that should be returned to the fluid cavity through the bleed port, the period of time the fluid cavity is in fluid communication with the bleed port and the differential pressure of the liquid across the bleed port. The volume of the liquid that is to be returned through the bleed port is a function of the volume of vapor in the fluid cavity and the extent to which the size of vapor bubble in the fluid cavity is to be reduced when exposed to the bleed flow from the bleed port. The period of time the fluid cavity is in fluid communication with the bleed port is a function of the rate of rotation of the rotor.

Figure 6:
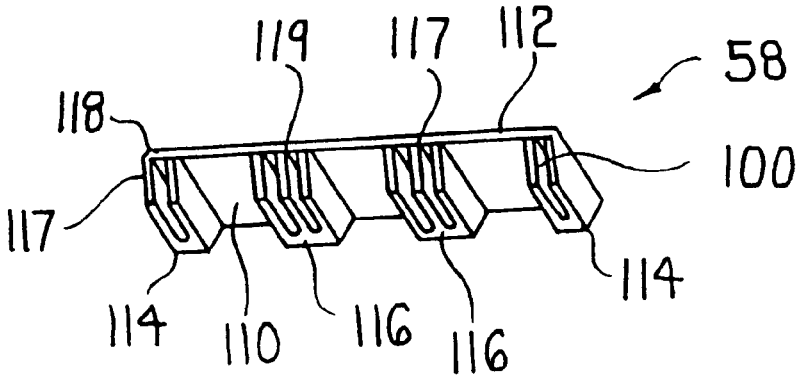
FIG. 6 is an exploded view of a vane that is internal to the pump.

As seen by reference to FIG. 6, each vane 58 is depicted to have a generally flat, rectangularly shaped body 110. The top edge of the body 110 forms a sealing surface 112 which is the surface of the vane 58 that abuts the inside wall of the liner 50 that defines the pump chamber 52. The vane 58 is further provided with a set of ribs 114 and 116 that are integrally formed with the body 110 and that extend the length of the body. Ribs 114 are located at the opposed ends of the body and are relatively narrow in width. Ribs 116 are located around the center of the body 110 and are relatively wide. Each rib 114 is formed to define a single slot 118. Each rib 116 is formed to define two slots 119 that are parallel with each other. It should further be observed that the upper portions of the ribs 114 and 116 are formed with bevelled surfaces 117 that meet the sealing surface 112 of the vane body 110.

Pump 22 of this invention functions in the same general manner as a conventional suction pump. As the rotor 54 turns, the centrifugal force developed urges the vanes 58 out of the slots 56 and against the inside wall of liner 50. Owing to the shape of the pump chamber 52, as the rotor 54 turns, the volume of each fluid cavity 96 increases in size. This increase in size causes a low-pressure field to develop in the fluid cavity as it is turned toward the openings 68 and 70 that define the inlet port into the pump chamber 52. This low pressure field thus draws fuel from storage tank 24 and through supply line 28, inlet line 40 and inlet chamber 38 into the pump chamber 52. As the rotor 54 continues to turn, the fluid cavity, and the fuel contained therein is rotated toward openings 78 and 80 forming the outlet port of the pump chamber 52. Since the fuel discharged from openings 78 and 80 is under pressure, it will be clear that while the majority of this fuel is discharged through discharge bore 60 in casing body 36. Nevertheless, a fraction of the fuel discharged does flow through bleed duct 102 as represented by arrows 120 in FIG. 3. This flow is the bleed flow.

Owing to the falling pressure in the fluid chambers presented to the inlet port of the pump chamber 52, fluid chambers 96*a* and 96*b*, in FIG. 3, the fuel in these chambers is prone to vaporize. The fluid chambers then subtend the second true radius section 88 of the liner 50; they become fluid chambers 96*c* and 96*d*. Once the fluid chambers reach this point in their rotation, the bleed flow fuel is forced into the chambers through bleed openings 104 and 106, respectively, as represented by arrows 122 and 124, respectively. This fuel pressurizes the vaporized bubbles of fuel within fluid chambers 96*c* and 96*d*. This pressurization serves to reduce the overall size and numbers of the vapor bubbles. When the rotor 54 is turned to the position wherein the fluid cavities decrease in size, become fluid cavities 96*e* and 96*f*, the size and number of vapor bubbles are significantly reduced. Consequently the amount of rapid compression or popping of the vapor bubbles that occurs in fluid chambers 96*e* and 96*f* is likewise reduced. The minimization of this rapid compression, popping, of vapor bubbles serves to hold the amount of noise generated by suction pump 22 to a minimum.

It should be further be recognized that the bleed flow is not lost. Thus, pump 22 of this invention suppresses cavitation without adversely affecting the rate at which fluid is discharged from the pump. Accordingly, relatively wide bleed ports can be provided if necessary to reduce a high rate of cavitation of the liquid being pumped.

Figure 7:
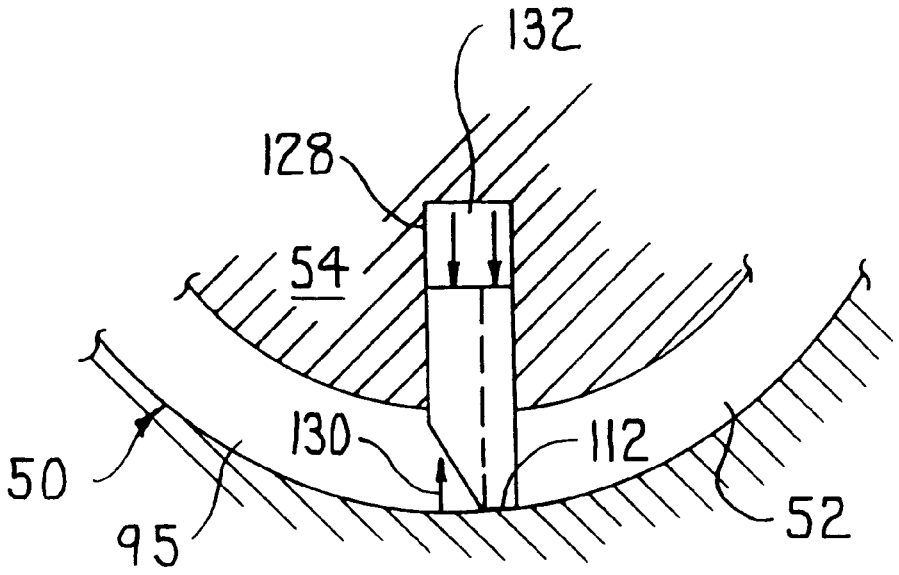
FIG. 7 is a side view illustrating the fluid forces acting on a vane during the operation of the pump.

Moreover, as seen by reference to FIG. 7, when the suction pump 22 the fuel, which is under pressure, flows into the space in slot 56 in which the vane 58 is normally seated. As represented by arrows 128 and 130, the opposed ends of the ribs 114 and 116 integral with the vane are exposed to equal and opposite pressurized fluid heads; these opposed forces cancel each other out. However, as represented by arrow 132, the bottom surface of the body 110 of the vane 58, the surface opposite sealing surface 112, is exposed to a pressurized fluid force that is not canceled out by any opposed force. Consequently, this fluid-generated force urges the vane 58 against the adjacent inner wall of the liner 50. This action facilitates formation of a relatively fluid tight seal between the vane 58 and liner 50 during the operation of the pump 22.

Thus, suction pump 22 of this invention, in addition to generating relatively minimal amounts of noise, is provided with an efficient mechanism for sealing its vanes 58 against the complementary liner 50. This serves to enhance the overall efficiency of the operation of this pump.

The foregoing description is limited to a preferred embodiment of this invention. It should be clear, however, that the structure may differ from what has been described and illustrated. For example, while the suction pump of this invention has been described for use in a fuel dispensing system 20, it should be clear that the pump may be employed in other fluid delivery systems, especially those systems used to deliver highly volatile liquids. Thus, the suction pump of this invention could be employed in a solvent delivery system, a chemical processing plant or a petroleum processing plant. Generally, the pump can be used in any liquid delivery system wherein the liquid is prone to vaporize. Also, it should likewise be understood that the pump need not just be employed as a dispensing pump. The pump may be used as a transfer pump to deliver liquid from one containment vessel to a second containment vessel such as are found in many industrial and chemical processing facilities.

Also, while in the described and illustrated version of the invention there are two fluid cavities located between the inlet and outlet ports of the pump, that need not always be the case. In some versions of the invention, there may be a need to have only a single fluid cavity within the fluid transport section 95 of the pump chamber 52. In still other versions of the invention, there may be three or more fluid cavities within the fluid between the inlet and outlet ports. Also, it should be recognized that the number of vanes the pump is provided with will be a function of the number the fluid cavities the pump is designed to form. At a minimum, 4 vanes are required. It is expected that in many preferred versions of the invention the pump will have 8 vanes. In some other versions of the invention, the pump may employ 12 vanes, or even more vanes.

Furthermore, there is no need that the suction pump of this invention always have an eccentrically shaped pump chamber. In some versions of this invention, the pump chamber may be circular and the rotor axially offset with the axis of the pump chamber.

Also, there is no requirement that there only be a single bleed port into each fluid cavity. In some versions of the invention, there may be two or more bleed ports per fluid cavity. Also, the bleed ports need not always have a circular profile. It should likewise be understood that in some versions of the invention, the bleed ports that open into the different fluid cavities may have different cross-sectional areas. Such dimensioning may be desirable in order to cause different compression pressures to develop in the individual fluid cavities as they rotate through the pump chamber. Also, in order to cause different pressure heads to appear in the fluid cavities, it may be desirable to vary the width of the bleed duct through which the pressurized fluid is returned to the fluid cavities.

It should likewise be understood that, in other versions of the invention, the liner may be eliminated and the pump chamber will be defined by interior walls of the pump casing. In these versions of the invention, the bleed duct and bleed ports may be formed directly in the pump casing. Alternatively, in some versions of the invention, the bleed duct and bleed ports may be wholly or partially formed in the face plate that is seated over the pump casing.

Also, in some versions of the invention, it may be desirable to place a flow-restricting member in the bleed duct 102 between the location at which the bleed flow enters the bleed duct and the downstream bleed ports 104 and 106. This member would reduce the bleed flow flow rate to the bleed ports. A potential advantage of reducing the flow rate of the bleed flow into the fluid cavities is that it would reduce the noise generated by the bleed flow itself without significantly adversely effecting the ability of the bleed flow to reduce the cavitation in the fluid cavities. Moreover, in some versions of the invention, this flow-restricting member may be positioned to direct the bleed flow so that there are different volumes of bleed flow into the individual fluid cavities. For example, it may be preferable to direct more bleed flow liquid into fluid cavity **96*d*, the cavity closest to the outlet port, than fluid cavity 96*c***, the cavity closest to the inlet port.

In some versions of the invention, these flow-restricting members may take the form of walls that extend into the bleed duct 102 and that have openings through which the bleed flow passes. These openings need not necessarily be circular openings. In versions of the invention wherein the pump is provided with the above-described liner 50, these walls can be integrally formed as part of the liner. For example, when it is desirable to reduce the amount of bleed flow into fluid cavity **96*c*, in comparison to fluid cavity 96*d*, the wall can be positioned to extend into bleed duct 102 between bleed ports 104 and 106**. Clearly, multiple flow restricting members may be provided at spaced apart locations throughout the bleed duct.

It should further be recognized that it is also possible to cause different quantities of bleed flow liquid to be returned to the individual fluid cavities **96*c* and 96*d*** by providing bleed ports with different sized openings into the individual cavities.

Therefore, it is an object of the appended claims to cover all such modifications and variations as come within the true spirit and scope of the invention.

The embodiments of the invention in which an exclusive property or privilege is claimed are defined as follows:

1. A suction pump, said suction pump having:

a pump casing, said pump casing having a pump chamber, an inlet port into said pump chamber and an outlet port from said pump chamber, wherein said inlet port and said outlet port are spaced apart from each other;

a rotor disposed for rotation in said pump chamber, wherein said rotor is positioned to define in said pump chamber a fluid transport section that is located between said inlet port and said outlet port; and a plurality of spaced apart vanes mounted to said rotor so as to extend from said rotor, wherein each adjacent pair of vanes defines a fluid cavity within said pump chamber and said vanes are arranged so that, during rotation of the rotor, a plurality of said fluid cavities are periodically completely positioned in the fluid transport section of said pump chamber; and wherein said pump casing is further formed to define a bleed duct that extends from said outlet port towards said fluid transport section of said pump chamber and a plurality of bleed ports are formed in said pump casing that provide fluid communication between the bleed duct and the fluid transport section wherein the bleed ports are positioned so that at least a first bleed port opens into a portion of the fluid transport section subtended by a first one of the fluid cavities and at least a second bleed port opens into a portion of the fluid transport section subtended by a second one of the fluid cavities.

2. The suction pump of claim 1, wherein said pump casing is formed so that said pump chamber has an at least partially eccentrically curved profile.

3. The suction pump of claim 1, wherein the bleed ports are shaped so that the bleed port that opens into the first one of the fluid cavities has cross sectional area different from the cross sectional area of the bleed port that opens into the second one of the fluid cavities.

4. The suction pump of claim 1, wherein: said pump casing is formed with a bore; and a liner is seated in said bore, said liner having an outer surface and an inner surface that defines said pump chamber.

5. The suction pump of claim 4, wherein said inner surface of said liner is formed so that said pump chamber has a profile that is at least partially eccentrically curved.

6. The suction pump of claim 4, wherein said liner is further formed with: a first opening from said outer surface to said inner surface that defines said inlet port to said pump chamber; a second opening from said outer surface to said inner surface that defines said outlet port from said pump chamber; an inwardly stepped section in said outer surface that extends from said second opening so as to define said bleed duct; and said bleed ports are formed in said liner so as to extend from said inwardly stepped section of said outer surface to said inner surface.

7. A suction pump comprising:

a pump casing that defines a pump chamber with inlet and outlet ports;

a rotor disposed in said pump chamber for rotation therein, said rotor and said pump casing defining a fluid transport section in said pump chamber that is spaced from said inlet and outlet ports; and a plurality of rotating vanes fitted to said rotor at spaced apart locations so as to define between said vanes a plurality of fluid cavities that rotate in said pump chamber wherein the volume of each said fluid cavity is a function of the position of said fluid cavity in said pump chamber, and, each said fluid cavity is rotated from said inlet port through said fluid transport section to said outlet port and, when each said fluid cavity is in said fluid transport section, said fluid cavity is isolated from said inlet port and said outlet port and, at least periodically during rotation of said rotor, at least two said fluid cavities are fully located in said fluid transport section and wherein said pump casing is further formed with a conduit that extends from said outlet port to said fluid transport section of said pump chamber said conduit having at least one first bleed port that opens into a section of said fluid transport section subtended by a first fluid cavity and at least one second bleed port separate from and spaced apart from the at least one first bleed port that opens into a section of said fluid transport section subtended by a second fluid cavity.

8. The suction pump of claim 7, wherein: said pump casing is formed with a bore; and a liner is seated in said bore, said liner being formed with an outer surface that is located adjacent an interior wall of said pump casing that defines the bore, an inner surface that defines the pump chamber, an inlet opening that extends from the pump casing inlet port to the pump chamber and an outlet opening that extends from the pump chamber to the pump casing outlet port.

9. The suction pump of claim 8, wherein the outer surface of said liner has an inwardly stepped section that extends from the liner outlet opening and that defines the conduit.

10. The suction pump of claim 7, wherein the bleed ports are shaped so that the bleed port that opens into the first one of the fluid cavities has cross sectional area different from the cross sectional area of the bleed port that opens int the second one of the fluid cavities.

11. A suction pump, said suction pump having:

a pump casing, said pump casing having a bore, an inlet port into the bore and an outlet port extending from the bore, wherein the inlet port and the outlet port are spaced from each other;

a liner fitted in the pump casing bore, said liner having an inner surface that defines a pump chamber that is fully enclosed by said liner, an outer surface located adjacent an inner wall of said pump casing that defines the pump casing bore, at least one inlet opening that extends from the pump casing inlet port into the pump chamber and at least one outlet opening that extends from the pump chamber to the pump casing outlet port;

a rotor disposed for rotation in the pump chamber, wherein said rotor is positioned to define in the pump chamber a fluid transport section that is located between the inlet opening and outlet opening; and a plurality of spaced apart vanes mounted to said rotor so as to extend from said rotor, wherein each adjacent pair of vanes defines a fluid cavity within the pump chamber and said vanes are arranged so that during rotation of the rotor, at least one fluid cavity is periodically completely positioned in the fluid transport section; and wherein said liner is formed so as to have an inwardly stepped section formed in the outer surface that extends from the outlet opening towards the inlet opening that defines a bleed duct that has a width and at least one bleed port that provides fluid communication between said bleed duct and the fluid cavity positioned in the fluid transport section of the pump chamber, the bleed port being surrounded by the bleed duct and having a diameter less than the width of the bleed duct.

12. The suction pump of claim 11, wherein: a plurality of vanes extend from said rotor so that a plurality of the fluid cavities are periodically positioned so as to be fully located within the fluid transport section of the pump chamber; and a plurality of said bleed ports are formed in said liner, at least a first one of the bleed ports opens into a portion of the fluid transport section that is subtended by a first fluid cavity and at least a second one of the bleed ports opens into a portion of the fluid transport section that is subtended by a second fluid cavity.

13. The suction pump of claim 11, wherein a plurality of bleed ports extend through said liner from the bleed duct to the fluid transport section of said pump chamber.

14. The suction pump of claim 11, wherein the inner surface of said liner is formed so that said pump chamber has a profile that is at least partially eccentrically curved.

15. A dispensing system for dispensing liquid-state fuel from a storage tank, said system including:

a suction pump connected to the storage tank comprising:

a pump casing that defines a pump chamber having an inlet port in fluid communication with the storage tank and an outlet port that is spaced from said inlet port; and a rotor assembly disposed in said pump chamber that has a plurality of vanes that rotate through said pump chamber so as to define a plurality of fluid cavities that rotate from said inlet port to said outlet port, wherein said pump casing is shaped so that within said pump chamber there is a fluid transport section that is located between said inlet and outlet ports through which said fluid cavities travel so that when each said fluid cavity passes through said fluid transport section, said fluid cavity is isolated from said inlet port and said outlet port and said pump casing and said rotor assembly are collectively configured so that a plurality of fluid cavities are periodically simultaneously located in said fluid transport section and are isolated from said inlet and outlet ports;

a bleed conduit establishing fluid communication between said outlet port and said fluid transport section wherein said bleed conduit includes a plurality of spaced-apart openings into the fluid transport section, wherein at least one first opening opens into a first one of the fluid cavities located in said fluid transport section and at least a second one of said openings opens into a second one of said fluid cavities located in said fluid transport section; and a flexible hose in fluid communication with said outlet port.

16. The dispensing system of claim 15, wherein said bleed conduit is formed in said pump casing.

17. The dispensing system of claim 15, wherein: said pump casing of said suction pump is formed with a bore; and a liner is seated in said bore, said liner being formed with an outer surface that is located adjacent an interior wall of said pump casing that defines the bore, an inner surface that defines the pump chamber, an inlet opening that extends from the pump casing inlet port to the pump chamber and an outlet opening that extends from the pump chamber to the pump casing outlet port.

18. The dispensing system of claim 17, wherein the outer surface of said liner has an inwardly stepped section that extends from the liner outlet opening and that defines the bleed conduit.

19. The dispensing system of claim 15, wherein the bleed ports are shaped so that the bleed port that opens into the first one of the fluid cavities has cross sectional area different from the cross sectional area of the bleed port that opens into the second one of the fluid cavities.

20. A method of suction pumping a liquid comprising the steps of:

providing a pump with a pump chamber that has: a first opening through which liquid is drawn into said pump chamber; a second opening spaced from said first opening through which liquid is discharged from said pump chamber; and a plurality of fluid cavities that move through said pump chamber and that are separated from each other;

creating a suction in each said fluid cavity when said fluid cavity is adjacent said first opening so that liquid is drawn into said fluid cavity;

moving each said fluid cavity, with the liquid therein, from said first opening to said second opening wherein, during a portion of said move, a plurality of the fluid cavities are isolated from said first opening and said second opening;

pressurizing each said fluid cavity when said fluid cavity is adjacent said second opening so as to cause the discharge of liquid through said second opening; and when at least two fluid cavities are isolated from said first and second openings, returning a portion of said liquid discharged from said second opening to the fluid cavities through separate bleed ports in the pump wherein the fluid returned to a first fluid cavity is returned through at least one first bleed port and the fluid returned to a second fluid cavity is returned through at least one second bleed port separate from the at least one first bleed port.

21. The method of suction pumping of claim 20, wherein the fluid returned to the first fluid cavity has a different pressure head than the pressure head of the fluid returned to the second fluid cavity.

* * * * *